US006279516B1

(12) United States Patent
Haugen et al.

(10) Patent No.: US 6,279,516 B1
(45) Date of Patent: Aug. 28, 2001

(54) CYLINDER HEAD WITH TWO-PLANE WATER JACKET

(75) Inventors: David James Haugen; Fernando Sandoval, both of Waterloo, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/505,022

(22) Filed: Feb. 16, 2000

(51) Int. Cl.[7] ..... F02F 1/36
(52) U.S. Cl. ..... 123/41.82 R; 123/41.82 A
(58) Field of Search ..... 123/41.82 R, 41.82 A

(56) References Cited

U.S. PATENT DOCUMENTS 4,083,333 * 4/1978 Rudert et al. ..... 123/41.82 R
4,214,560 7/1980 Nikly .
4,291,650 9/1981 Formia et al. .
4,455,973 6/1984 Stadler et al. .
5,682,850 11/1997 Matayoshi .
5,983,844 * 11/1999 Hauder ..... 123/41.82 R

* cited by examiner

*Primary Examiner*—Tony M. Argenbright
*Assistant Examiner*—Katrina B. Harris

(57) ABSTRACT

A cylinder head for an engine having a two-plane water jacket in which a lower chamber at one plane through the head cools the fire deck of each cylinder and a cross-flow passage for the coolant is spaced above the lower chambers in a second plane through the head directs coolant to an outlet. The two planes of the water jacket are connected by an annular passage surrounding the injector nozzle sleeve and has machined surfaces whereby the size of the flow channel and thus the coolant flow between the two planes is better controlled to enable more even cooling of the fire deck resulting in less variability in fire deck temperature from one cylinder to one another. The lower chambers cooling the fire deck are separate for each cylinder to prevent heated coolant from one cylinder flowing to the next cylinder fire deck.

13 Claims, 3 Drawing Sheets

CYLINDER HEAD WITH TWO-PLANE WATER JACKET

BACKGROUND OF THE INVENTION

1. Field of the Invention

The present invention relates to a cylinder head for an engine and in particular to a cylinder head having a two-plane water jacket in which a lower chamber at one plane through the head cools the fire deck of each cylinder and a cross-flow passage spaced above the lower chambers in a second plane through the head directs coolant to an outlet. Less variability in fire deck temperature results from separating the lower chambers of each cylinder from one another.

2. Description of the Related Art

Typical heavy-duty diesel engine design relies on water jacket cooling that produces inconsistent cooling with higher temperatures at one end of the cylinder head fire deck than at the other. This results from a water jacket in which coolant from the cylinder head fire deck furthest from the coolant outlet flows through the cylinder head past the fire decks of the remaining cylinders as the coolant travels toward the coolant outlet. The fire deck of the cylinder nearest the coolant outlet is hotter than the fire deck of the cylinder furthest from the coolant outlet.

SUMMARY OF THE INVENTION

The present invention overcomes the inconsistent cooling of prior designs by providing a water jacket with two "planes," or levels, of cooling in the cylinder head cooling circuit. The lower, directed cooling plane allows the coolant flowing into the cylinder head from the cylinder block to cool the fire deck of only one cylinder. The coolant flows upward from the directed cooling plane to an upper transport plane containing a cross-flow passage that directs the coolant to a coolant outlet without the coolant interacting with the direct cooling of the fire deck area of any other cylinders.

An upward flow channel is provided between the directed cooling plane and the upper transport plane. Preferably, this is an annular channel surrounding the injector nozzle sleeve where access to the bore surface from outside the head is provided so that the surface of the bore can be machined. Since the bore surface in the head and the injector nozzle sleeve surface are machined, the size of the channel is controlled by machine tolerances rather than by casting tolerances. This results in very little flow variation from one cylinder to the other, producing even cooling among the cylinders.

DESCRIPTION OF THE PREFERRED EMBODIMENT

Figure 1:
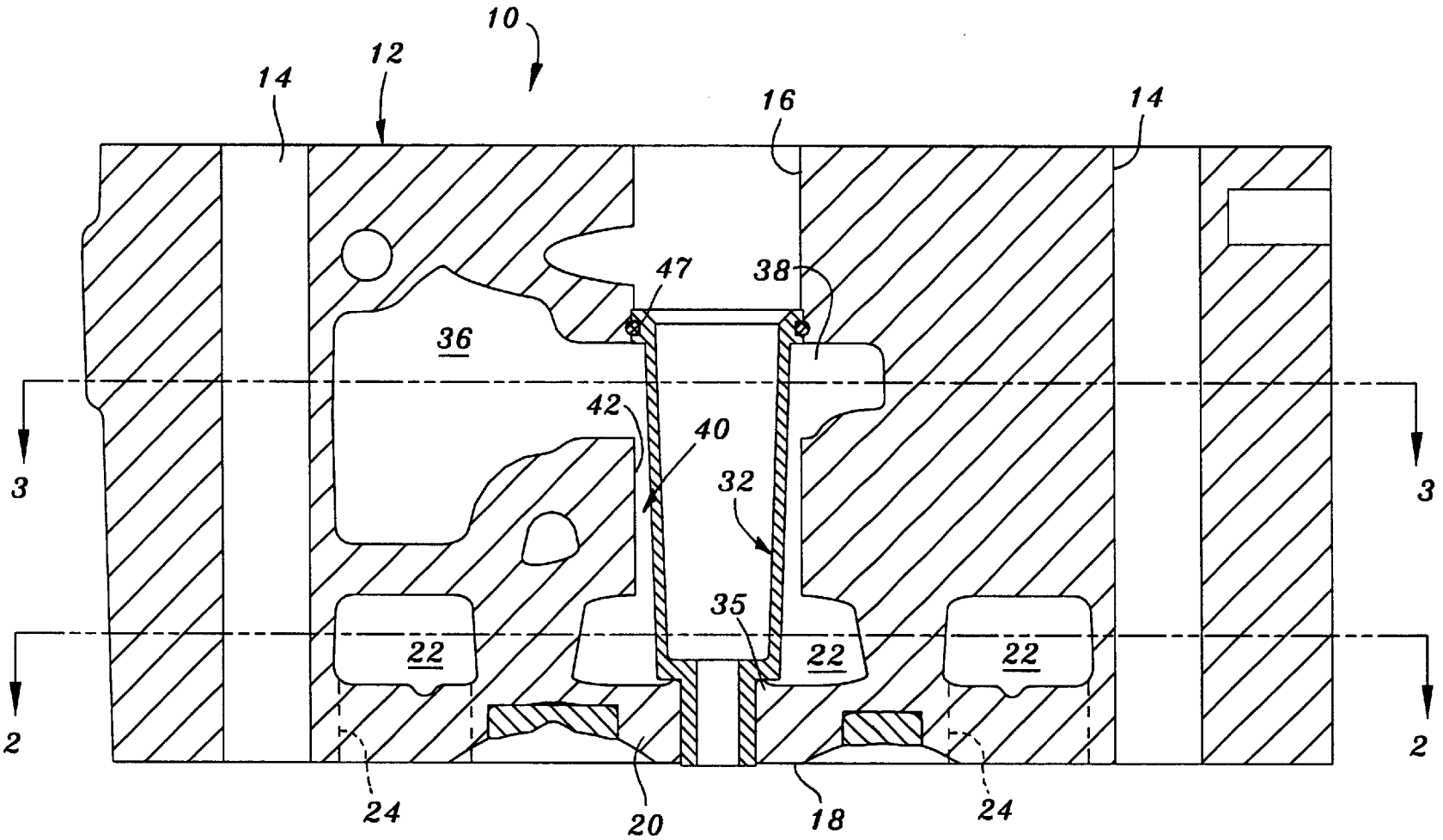
FIG. 1 is a vertical sectional view of the cylinder head showing the water jacket according to the present invention.

With reference to FIG. 1, the cylinder head of the present invention is shown and labeled generally as 10. The cylinder head includes a cast iron body 12 that is cast with various passages therein in a known manner. The passages include the bores 14 for mounting bolts, bores 16 for a fuel injector, various passages for intake and exhaust valves (shown in FIGS. 2 and 3) as well as passages forming a water jacket as described in greater detail below. A lower wall 20 forms the lower surface of the cylinder head that is the fire deck 18 for each cylinder. The fire deck forms the upper surface of the combustion chamber of each cylinder and is the portion of the cylinder head that requires the greatest cooling. The water jacket of the cylinder head provides directed cooling of the fire deck.

Figure 2:
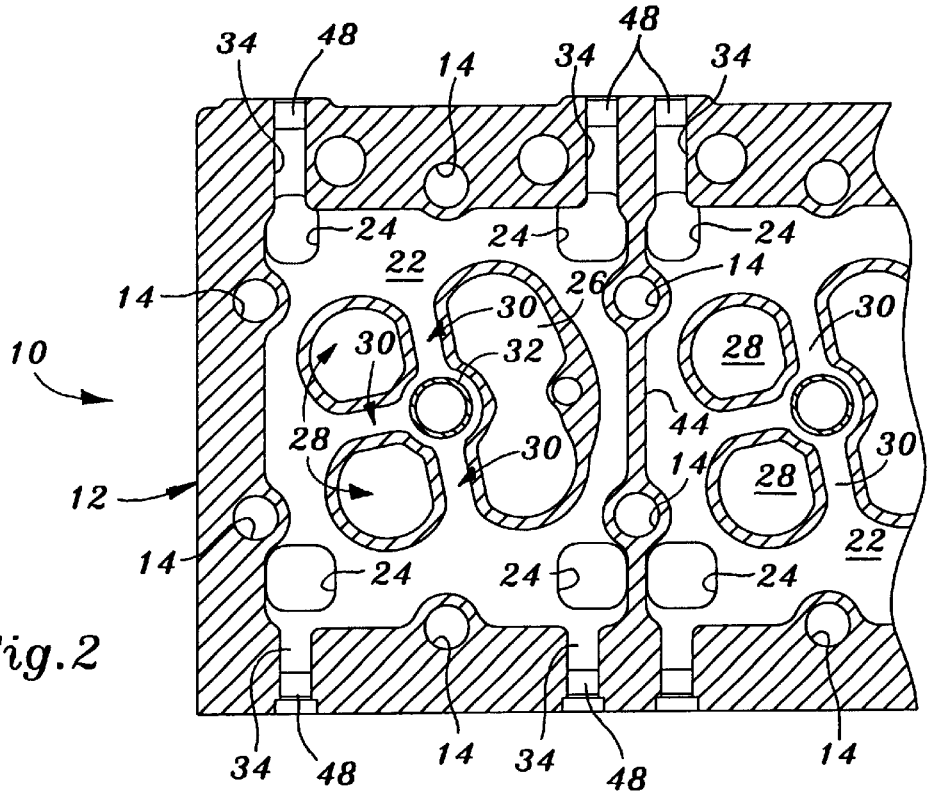
FIG. 2 is a horizontal sectional view as seen substantial along the 2—2 of FIG. 1.
Figure 5:
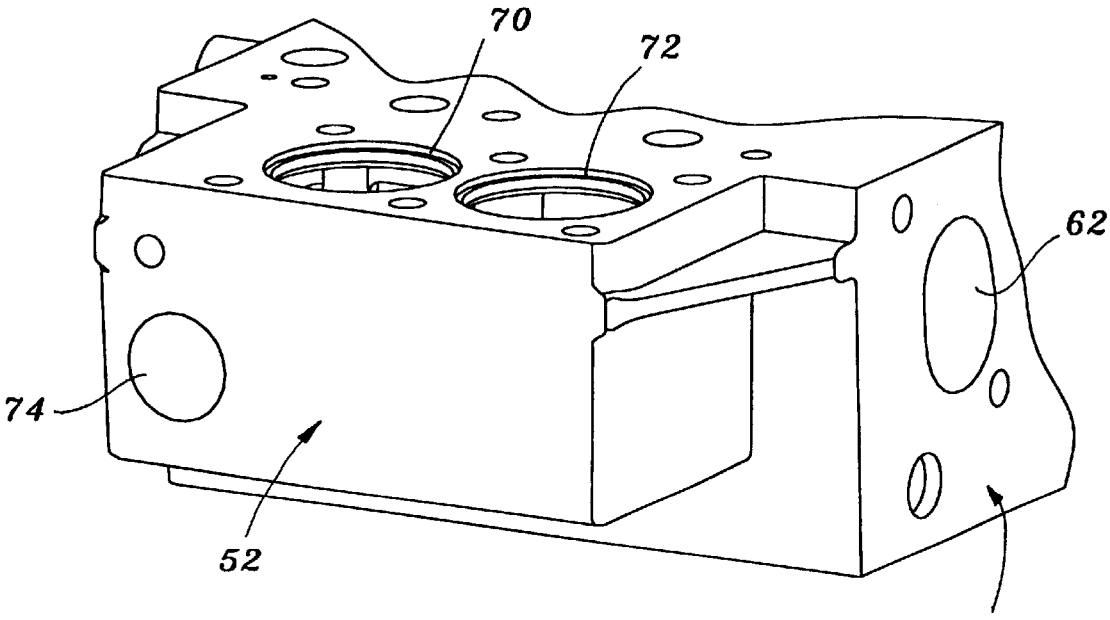
FIG. 5 is a perspective view of one end of the cylinder head.

The cylinder head of the present invention is provided with a water jacket arranged on two separate planes of the cylinder head. A lower directed cooling plane includes a lower chamber 22 shown in FIGS. 1 and 2. The lower chamber 22 is immediately above a lower wall 20 of the cylinder head, the lower surface of which forms the fire deck 18. The lower chamber 22, as best seen in FIG. 2, is generally rectangular in shape with inlets 24 in the four corners that receive coolant from the water jacket of the engine block. The lower chamber 22 surrounds the passage 26 for intake air and passages 28 for exhaust gas. Each exhaust passage 28 terminates at an outlet 62 on the side of the cast iron body 12 of the cylinder head. (FIG. 5). While the invention is shown in an engine having two intake and two exhaust valves, it will be readily appreciated that the cylinder head of the present invention can be used with an engine having more or fewer valves. Several branches 34 extend from the lower chamber 22 that are formed by portions of the casting core that support the core in the casting mold. Branches 34 are closed by freeze plugs 48.

The lower chamber 22 includes branches 30 for coolant flow between the passages 26 and 28 to the center of the lower chamber 22 surrounding the fuel injector nozzle sleeve 32. The nozzle sleeve 32 is fitted within the bore 16 and extends through to the fire deck 18. A seal 35 is formed at between the sleeve 32 and the lower wall 20 to prevent coolant from leaking from the water jacket lower chamber 22 into the combustion chamber therebelow. An O-ring seal 47 seals the upper end of the injector sleeve 32 to the cylinder head body 12.

Figure 3:
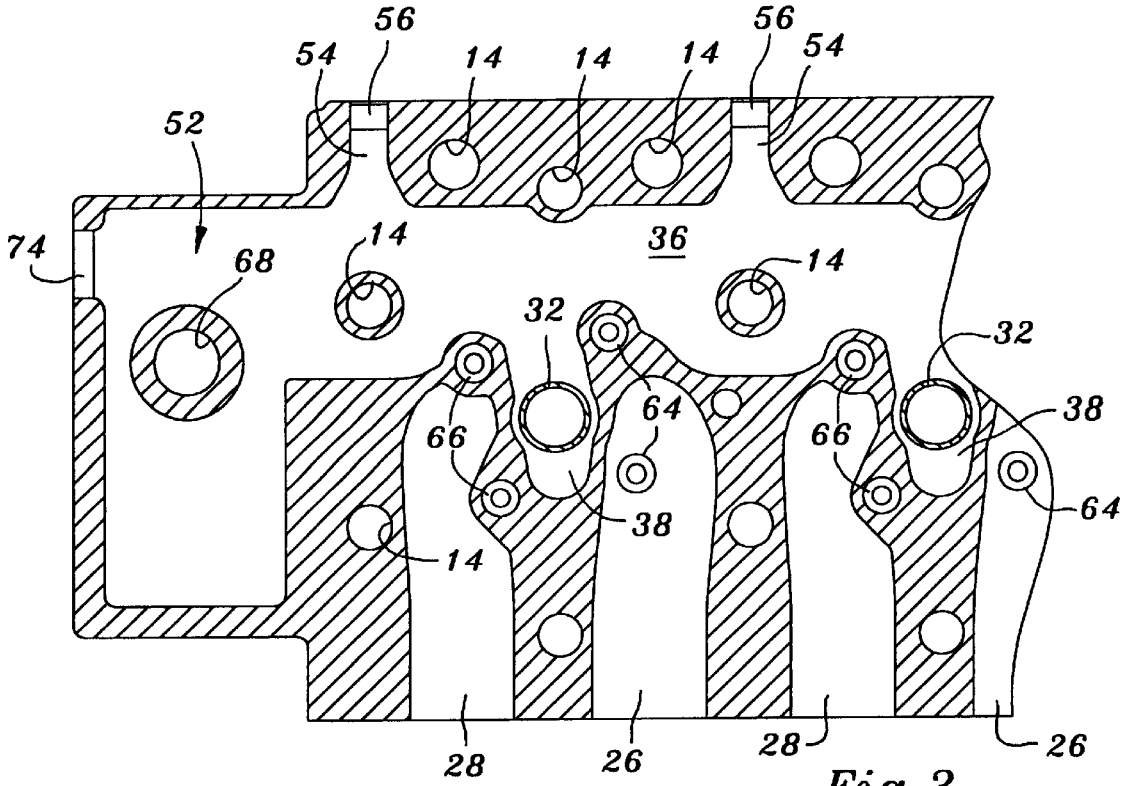
FIG. 3 is a horizontal sectional view of the cylinder head of the present invention as seen from substantial line 3—3 of FIG. 1.

The water jacket further features an upper transport plane containing a cross-flow channel 36 and a connecting portion 38. The transport plane is connected to the lower cooling plane by an annular channel 40 formed between the injector sleeve 32 and the inner surface 42 of the injector bore 16. The cross-flow channel 36 is shown in FIG. 3 and directs coolant to a reservoir 52 at one end of the head. The cross-flow channel 36 is also formed with branches 54. The branches 54 are formed by portions of the casting core that support the core in the casting mold. These branches are closed by additional freeze plugs 56. FIG. 3 further shows the intake air and exhaust gas passages 26, 28 through the head as well as the valve guides 64, 66 for the intake and exhaust valves. The coolant reservoir 52 includes a bypass outlet 68 for coolant flow when the engine is cold that is controlled by a thermostat, not shown, mounted in an upper opening 70 in the reservoir, shown in FIG. 5. The other opening 72 in the reservoir is the coolant outlet for heated coolant exiting the cylinder head 10 and is also thermostatically controlled. The reservoir 52 also has a freeze plug 74.

Coolant flows into the cylinder head through the inlets 24 at the four corners of the lower chamber 22. The coolant flows radially inward, around the intake and exhaust passages 26, 28 to the center of the lower chamber 22 and to the flow channel 40. There, the coolant rises to the transport plane where the coolant passes through the connecting portion 38 to the cross-flow passage 36. Once in the cross-flow passage 36, the coolant is directed to the coolant outlet 72 at the end of the head.

The lower, directed cooling plane of the water jacket includes a lower chamber 22 for each cylinder for a multi cylinder engine with the lower chambers 22 being separated from one another. A portion of a lower chamber 22 of an adjacent cylinder is shown in FIG. 2. The adjacent lower chambers 22 are separated by a wall 44 in the cast body 12. Coolant must flow from the lower chamber 22 through the flow channel 40 to the upper transport plane where the coolant is directed by the cross-flow channel 36 to the coolant outlet 72 (FIG. 5) at one end of the head. Coolant that is heated from the fire deck in one lower chamber 22 does not flow into another lower chamber 22. The fire deck for each cylinder receives the same degree of cooling, producing better control of the mean temperature in the lower chamber 22 and the fire deck 18. There is less variation in temperature among the fire decks of the multiple cylinders.

One feature of the cylinder head that enhances control of the coolant flow through the head is that the surface 42 of the bore 16 is a machined surface as is the outer surface of the injector sleeve 32. The size of the flow channels 40 is controlled within machining tolerances instead of casting tolerances, whereby variation in the size of the flow channels 40 among the cylinders is more precisely controlled. The precise control of the size of the flow channel 40 is made possible by locating the channels in the injector bores where access from the outside is possible for machining the bore surface.

Figure 4:
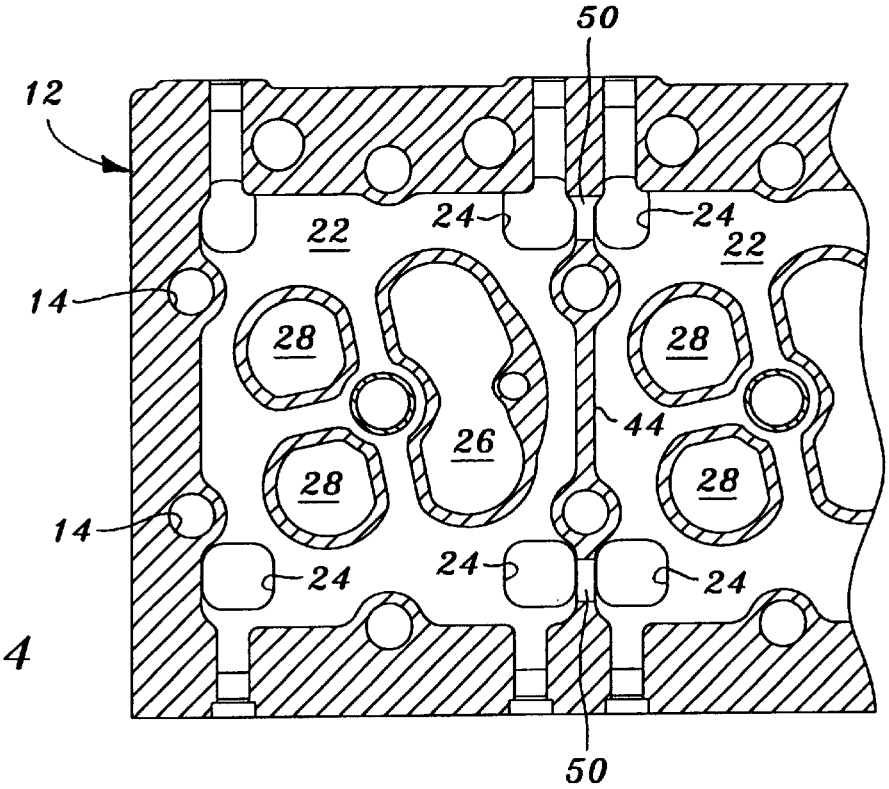
FIG. 4 is a horizontal sectional view as seen substantial along the 2—2 of FIG. 1 of an alternative embodiment of the present invention.

An alternative embodiment of the invention is shown in FIG. 4. There, a small interconnecting passage 50 through the wall 44 is provided between adjacent lower chambers 22 on one or both sides. The interconnecting passages 50 are the result of connecting portions of the sand core that form the lower chambers 22 in the cast body 12. Greater stability of the core may be provided by connecting the lower chambers 22 with a small connector that forms the passage 50. With the coolant flow as described above, little interchange of coolant from one lower chamber 22 to another is likely to occur. As a result, the benefits described above can be substantially achieved even with an interconnection between adjacent lower chambers 22.

The invention should not be limited to the above-described embodiment, but should be limited solely by the claims that follow.

We claim:

1. A cylinder head for a multi-cylinder engine comprising a body having a lower wall defining a firing deck for each cylinder, the body having a hollow interior space forming a water jacket for cooling the cylinder head, the water jacket having, for each cylinder, a lower chamber adjacent the lower wall for cooling the firing deck, each lower chamber having at least one inlet for receiving coolant, an upper chamber spaced above the lower chamber and a channel extending between the lower and upper chambers, the water jacket further including a cross-flow passage in communication with each of the upper chambers for directing the coolant from each upper chamber to a coolant outlet whereby coolant flows into each lower chamber through the inlets thereof, through each channel to each upper chamber and from each upper chamber to the cross-flow passage and from there to the coolant outlet, wherein the channel is formed by a bore in the body and a fuel injector nozzle sleeve within the bore spaced inwardly from the surface of the bore whereby the channel is annular.

2. The cylinder head as defined by claim 1 wherein the lower chambers are separate from one another to prevent flow of coolant from one lower chamber to another without flowing through the channel and upper chamber of the associated cylinder and through the cross-flow passage.

3. The cylinder head as defined by claim 1 wherein adjacent lower chambers are coupled to one another by connecting passages permitting coolant flow between the adjacent lower chambers.

4. The cylinder head as defined by claim 1 wherein the channel is formed by a bore in the body with a machined surface.

5. The cylinder head as defined by claim 1 wherein the channel is located approximately in the center of the lower chamber and wherein the lower chamber has a plurality of inlets at radially outer locations relative to the channel whereby coolant flows inward from the inlets to the channel.

6. The cylinder head as defined by claim 5 wherein the lower chamber is generally rectangular in shape in a plan view with inlets in the four corners of the lower chamber.

7. A cylinder head for a multi-cylinder engine comprising a body having a lower wall defining a firing deck for each cylinder, the body having a hollow interior space forming a water jacket for coolant flow through the body, the water jacket having a lower chamber for each cylinder adjacent the lower wall, each lower chamber having at least one inlet for receiving coolant, the water jacket further having a cross-flow passage spaced from the lower chambers and terminating in a coolant outlet, the cross-flow passage being in fluid communication with each lower chamber to receive coolant via annular flow channels defined by bores in the body and fuel injector sleeves within the bores spaced inwardly from the surface of the bores and extending upward from each lower chamber, whereby coolant flows from each lower chamber to the cross-flow passage and through the cross-flow passage to the coolant outlet.

8. The cylinder head as defined by claim 7 wherein the bores forming the flow channels have a machined surface.

9. The cylinder head as defined by claim 7 wherein the flow channels are located approximately in the center of the lower chambers and the lower chambers have multiple inlets at radially outer locations from the flow channels.

10. A cylinder head for a multi-cylinder engine comprising a body having a lower wall defining a firing deck for each cylinder, the body having an interior space forming a water jacket for cooling the cylinder head, the water jacket having two planes of cooling in the head, lower directed cooling plane above the lower wall for cooling the fire deck and an upper transport plane spaced above the lower directed cooling plane and including a cross-flow passage for directing coolant to a coolant outlet, the water jacket further having a flow channel for each cylinder located in a bore in the body that also contains a fuel injector nozzle sleeve, thereby providing fluid communication between the lower directed cooling plane and the upper transport plane and a coolant inlet for each cylinder into the lower directed cooling plane.

11. The cylinder head as defined by claim 10 wherein for each cylinder the lower directed cooling plane includes a lower chamber immediately above the lower wall for cooling the fire deck.

12. The cylinder head as defined by claim 11 wherein the lower chamber for each cylinder is separated from the lower chambers associated with the other cylinders of the head.

13. The cylinder head as defined by claim 11 wherein the lower chamber for each cylinder is connected to an adjacent lower chamber.

* * * * *